United States Patent [19]

Tucker

[11] 4,429,598

[45] Feb. 7, 1984

[54] REVERSIBLE WRENCH

[76] Inventor: Howard F. Tucker, 53 Fall Clove, R.D. 1, Delancey, N.Y. 13752

[21] Appl. No.: 320,294

[22] Filed: Nov. 12, 1981

[51] Int. Cl.[3] ..... B25B 13/00

[52] U.S. Cl. ..... 81/59.1

[58] Field of Search ..... 81/59.1; 192/44

[56] References Cited

U.S. PATENT DOCUMENTS

| | | | |
|---|---|---|---|
| 2,061,288 | 11/1936 | Murry | 192/44 |
| 3,362,267 | 1/1968 | Rozmus | 81/59.1 |
| 3,621,739 | 11/1971 | Seablom | 81/59.1 |

*Primary Examiner*—James L. Jones, Jr.
*Attorney, Agent, or Firm*—John Maier

[57] ABSTRACT

A reversible wrench with a selector which may be shifted to determine the directions in which the wrench will drive and slip. A polygonal opening is located in the wrench. A socket driver is located in this opening with a roller for each polygonal intersection point located between the polygonal opening and the driver. A pair of energizer springs are located between each contiguous pair of rollers and a separator affixed to the selector is located between each pair of springs.

3 Claims, 4 Drawing Figures

REVERSIBLE WRENCH

FIELD OF THE INVENTION

A. Field of the Invention

This invention is in the field of reversible socket wrenches in which the driver can be moved in one direction while driving and can also be rotated backwardly without driving.

STATEMENT OF THE PRIOR ART

Socket wrenches have been traditionally built with a ratchet design. The rachet design provided a worthwhile reversible wrench for many applications. However, when working in limited space, where the arcuate movement of the wrench was very small, it was not always possible to move the handle of the wrench back sufficiently so that the wrench would engage the next rachet tooth. Therefore, it was necessary to use a reversible driving concept requiring a minimal arcuate return of the handle. As a result, various clutch-type wrenches have been designed including the use of a polygonal opening with rollers. However, such units have been complex resulting in high cost and more difficult maintenance.

The principle object of this invention is to provide a device for an article of this character which combines easy use and simple construction along with durability.

Other objects of this invention will in part be obvious and in part hereafter pointed out.

The invention clearly consists of the features of construction, combination of elements and arrangements of parts which will be exemplified in the construction hereinafter described of which the scope of application will be indicated in the following claims.

SUMMARY OF THE INVENTION

A reversible wrench is formed with a handle having a body at one end with a cavity of polygonal cross section. The polygonal cross section includes a plurality of pairs of continuous flat side walls. Each pair of continuous flat side walls forms an apex. A cylindrical drive member, with a general cylindrical portion, is located within the cavity. Between the cavity and the drive member, there is located a plurality of rollers with one roller for each pair of continuous flat side walls of the cavity. A selector lever is mounted on the side of the handle at the body adjacent the cavity and the selector is so adapted as to be moved by a finger grasping the handle to one of two angularly-separated positions.

A plurality of separators are rigidly secured to the selector lever and extend from the selector level between the cavity and the drive member. A spring means is located on each side of a separator. Each spring means is located between a roller and a separator.

The novel features which are considered as characteristic of the invention are set forth with particularity in the appended claims.

The invention itself, however, as to its construction and obvious advantages will be best understood from the following description of the specific embodiment when read with the accompanying drawings.

BRIEF DESCRIPTION OF THE DRAWINGS

In the accompanying drawings, wherein like reference characters identified the same or like part, there are shown three embodiments of this invention.

DETAILED DESCRIPTION OF THE PREFERRED EMBODIMENTS OF THE INVENTION

Figure 1:
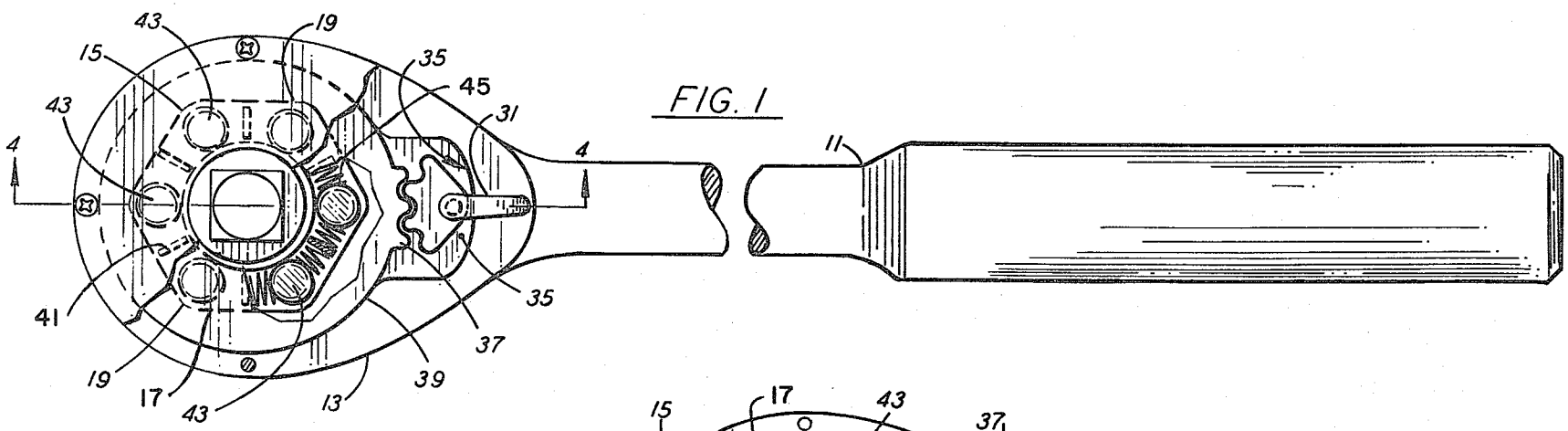
FIG. 1 is a plan view of the reversible wrench in an unlocked position showing a part of the enclosure broken away in order to better show the action of the reversing parts.

The reversible wrench includes a handle 11 with an enlarged body 13 located at one end. Within the enlarged body 13 a cavity 15 is located. The cavity 15 has a polygonal shape formed from a series of flat surfaces 17 which in turn are the side walls of the cavity 15. Each pair of flat surfaces 17 form an apex 19 pointing away from the center of the cavity 15. The number of flat surfaces 17 used can vary but at least four pair of eight flat surfaces 17 is recommended.

Figure 4:
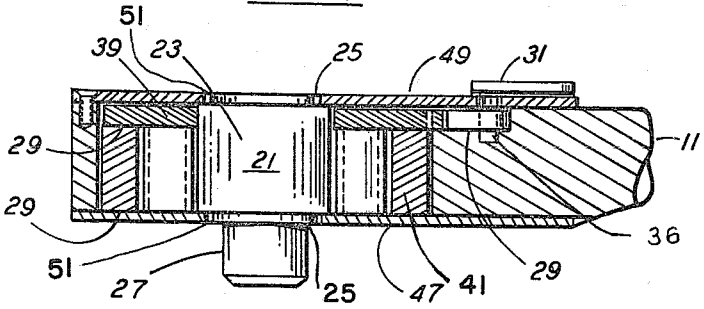
FIG. 4 is a cross-sectional view of the reversible wrench along the line 4—4 of FIG. 1.

A socket adaptor 21 is located centrally within the cavity 15 as can be best seen in FIG. 4. The socket adaptor 21 has a cylindrical portion 23 which is located concentrically within the cavity 15 but is substantially smaller than the cavity 15 leaving a radial distance between the socket adaptor 21 and the cavity 15. End portions 25, also cylindrical but smaller in diameter than the cylindrical portion 23, extend outside the cavity 15 on both sides of the enlarged body 13. On the opposite side of the socket adaptor 21 from the end portions 25, a drive member 27, normally used with socket wrenches, is located. The drive member 27 is well known in the art for engaging a variety of sockets which in turn fit various items, particularly nut and bolt heads of various sizes and types.

The enlarged body 13 includes two generally parallel flat surfaces 29 and the cavity 15 extends substantially perpendicularly between the two generally parallel flat surfaces 29. On the enlarged body 13, preferably on the opposite side from where the drive member 27 is located, there is located a selector lever 31. The selector lever 31 is pivotable between two predetermined positions, one shown in FIG. 2 and the other shown in FIG. 3. The selector lever 31 is affixed to a gear drive 33 and both the selector lever 31 and the gear drive 33 are pivotably mounted on one of the flat surfaces 17. Stop means 35 are provided to limit the angular movement of the selector level 31 in both directions. Since the selector lever 31 is externally located and the gear drive 33 is internally located, a pin 36 is used to affix the selector lever 31 and the gear drive 33 to one another and to pivotably mount the selector lever 31 and the gear drive 33 in the enlarged body 13.

The gear drive 33 interacts with a gear section 37 located on ring member 39. Extending from and secured to the ring member 39 are a plurality of separators 41. As can be best seen in FIG. 4, each separator 41 is essentially a flat rectangularly-shaped bar located along the radius of the socket adaptor 21. The number of separators 41 is equal to the number of apexes 19 formed by the pairs of flat walls 29 of the cavity 15. For each apex 19 there is one separator 41. The separators 41 extend along the radial distance between the socket adaptor 21 and the cavity 15. When the selector lever 31 is located substantially midway between the two working positions, as shown in FIG. 1, each separator 41 is substantially midway between two contiguous apexes 19.

Figure 2:
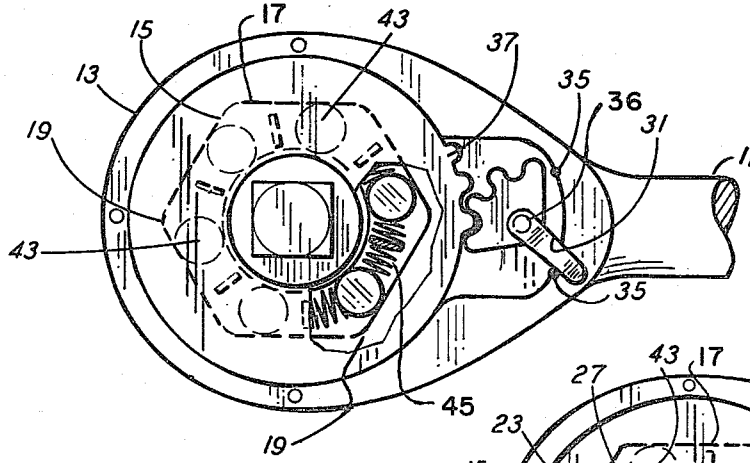
FIG. 2 is a similar view to FIG. 1 with some of the parts in a changed position.
Figure 3:
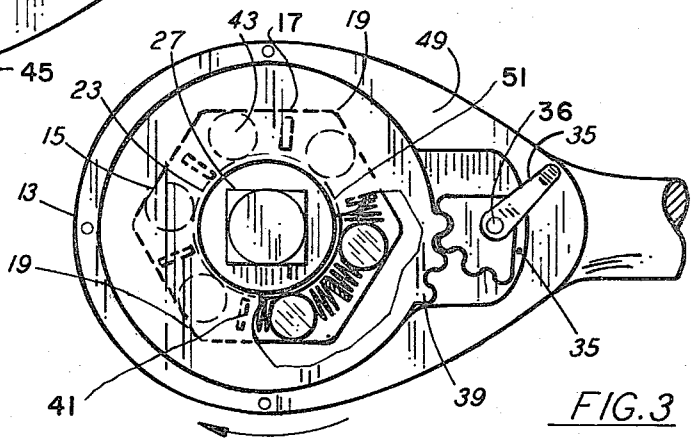
FIG. 3 is a similar view to FIG. 2 showing the parts in a reversed position for rotation in the opposite direction.

Also between the socket adaptor 21 and the cavity 15, there are a plurality of rollers 43 sized to fit loosely between the socket adaptor 21 and the cavity 15 at each apex 19 but also sized to fit snugly against each flat surface 17 when moved off the apex 19 in either direction. A pair of springs 45 is located on opposite sides of each separator 41. The springs 45 are preferably formed from a spring steel bent in a series of leaves with approximately five alternating creases. As a result, there is a spring 45 located between each roller 43 and each separator 41. As the selector lever 31 is moved in either direction, it relaxes one of the pair of springs 45 located on opposite sides of a roller 43 while compressing the other spring 45. When the ring member 39 is moved in a clockwise direction, as seen in FIG. 3, by moving the selector lever 31 to the right, the handle 11 is locked when moved in a counterclockwise direction but can rotate freely when moved in a clockwise direction. Similarly, if the selector lever 31 is moved to the right as seen in FIG. 2 thereby moving the ring member 39 in a counterclockwise direction, the handle 11 will be free to rotate in a counterclockwise direction and but will be locked when rotated in a clockwise direction.

As best seen in FIG. 4, there is a lower cover plate 47 and an upper cover plate 49. The lower cover plate 47 is located against the flat surface 29 which is adjacent the drive member 27. The upper cover plate 49 is located over the ring member 39 which is rotatably mounted on the opposite flat surface 29. The gear drive 33 is in the same place as the ring member 39 and the upper cover plate 49 also encloses both the gear drive 33 and ring member 39. The pin 36 is rotatably mounted through the upper cover plate 49 so that the selector lever 31 is mounted outside the upper cover plate 49.

A journel opening 51 is located in both the lower cover plate 47 and the upper cover plate 49. Each end portion 25 of the socket adaptor 21 is rotatably fitted in one of the journal openings 51. In this manner, the socket adaptor 21 can rotate while being securely held in the cavity 15.

It is thought that persons skilled in the art to which this invention relates will be able to obtain a clear understanding of the invention after considering the foregoing description in connection with the accompanying drawings. Therefore, a more lengthy description is to be deemed unnecessary.

The invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning of range and equivalency of the claims are, therefore, intended to be embraced therein.

I claim:

1. A reversible wrench comprising:

a handle having an enlarged body at one end with a cavity therein having a polygonal cross section, said polygonal cross-section including a plurality of pairs of continguous flat side walls, each pair of contiguous flat surfaces forming an outwardly extending apex, said enlarged body having two outside flat parallel surfaces;

a drive member located within said cavity;

a plurality of rollers disposed between said drive member and said cavity, the number of rollers being equal to the number of pairs of contiguous flat side walls forming apexes;

a selector means including a flat ring rotatably mounted on one outside surface of said enlarged body with a plurality of separators rigidly secured thereto and extending between said cavity and said drive member, said selector further including a lever means for rotating said flat ring;

pairs of spring means located on opposite sides of said separators, each separator being located between two of said plurality of rollers; and means for retaining said drive member, rollers, selector and spring means affixed to said handle.

2. A reversible wrench according to claim 1 wherein said selector includes a selector lever.

3. A reversible wrench comprising:

a handle having an enlarged body at one end, said enlarged body having two substantially parallel outside surfaces and having a cavity with a polygonal cross-section with a plurality of pairs of contiguous flat surfaces, each pair of contiguous flat surfaces forming an outwardly extending apex;

a drive member having a generally cylindrical portion located within said cavity;

a plurality of rollers disposed between said cylindrical portion of said drive member and said cavity of polygonal cross-section, the number of rollers being equal to the number of pairs of contiguous flat side walls forming apexes;

a selector means including a flat ring rotatably mounted on one outside surface of said enlarged body with a gear section and with a plurality of separators rigidly secured to the ring member and extending from said ring member between said cavity and said drive member, each separator having a rectangular shape and being aligned radially from the center of said drive member, said selector further including a gear drive engaging said gear section and a lever, both said gear section and said lever being rigidly connected to one another and rotatably mounted on said enlarged body;

stop means in said enlarged body to limit the movement of the selector lever in both directions;

a plurality of pairs of spring means, each springs means of each pair of spring means being located on opposite sides of one of said separators, each separator being located between two contiguous rollers; and cover means for retaining said drive member, rollers, selector and spring means affixed to said handle.

* * * * *